US010335707B2

(12) United States Patent
Nunes et al.

(10) Patent No.: US 10,335,707 B2
(45) Date of Patent: Jul. 2, 2019

(54) MODULAR DEMOUNTABLE SAFETY PANELS, COMPATIBLE WITH APPLICATION ON CONCRETE BASES OR METAL BARRIERS AT MOTOR RACING CIRCUITS AND THEIR RESPECTIVE ASSEMBLY PROCESS

(71) Applicant: Rodrigo & Squeira, Associados—Projectos Urbanos, Lda, Oporto (PT)

(72) Inventors: Rodrigo Pereira Nunes, Oporto (PT); Maria Susana Ferreira de Oliveria da Curz e Silva Nunes, Oporto (PT); António Abel de Melo Nunes, Oporto (PT)

(73) Assignee: LEADERTECH, UNIPESSOAL, LDA (ZONA FRANCA DA MADEIRA), Funchal (PT)

( * ) Notice: Subject to any disclaimer, the term of this patent is extended or adjusted under 35 U.S.C. 154(b) by 391 days.

(21) Appl. No.: 14/620,150

(22) Filed: Feb. 11, 2015

(65) Prior Publication Data

US 2015/0225912 A1 Aug. 13, 2015

(30) Foreign Application Priority Data

Feb. 11, 2014 (PT) ..... 108018

(51) Int. Cl.
*E04H 17/16* (2006.01)
*A63K 1/00* (2006.01)
(Continued)

(52) U.S. Cl.
CPC ..... *A63K 1/00* (2013.01); *E01F 13/022* (2013.01); *E01F 15/0407* (2013.01);
(Continued)

(58) Field of Classification Search
CPC ..... A63K 1/00; E01F 13/022; E01F 15/0407; E01F 15/0461; E01F 15/083;
(Continued)

(56) References Cited

U.S. PATENT DOCUMENTS 4,685,656 A * 8/1987 Lee ..... E01F 15/025 256/13.1
4,841,697 A * 6/1989 Hogg ..... E04F 11/1851 198/335

(Continued)

*Primary Examiner* — Amber R Anderson
*Assistant Examiner* — Nahid Amiri
(74) *Attorney, Agent, or Firm* — John Alumit

(57) ABSTRACT

A new type of demountable modular panel and its respective assembly process, intended for use on motor sports circuits, particularly on urban circuits. It has the advantage of being easily assembled and disassembled, allowing easy access to any point on the circuit. It can be used on metal barriers or on concrete bases fitted with "U" section metal guides at their ends, into which a metal support profile is inserted. Above the base, a fencing panel is placed, with a top section included at 45°. A tubular metal shaft is introduced vertically through metal connectors and tightly clamped in rectangular retention brackets. The attachment of the panel is reinforced by "L" section metal brackets and respective bolts with washers.

1 Claim, 12 Drawing Sheets

(51) Int. Cl.
*E01F 15/08* (2006.01)
*E01F 13/02* (2006.01)
*E01F 15/04* (2006.01)
*E04H 17/22* (2006.01)
*E04H 17/24* (2006.01)

(52) U.S. Cl.
CPC ..... *E01F 15/0461* (2013.01); *E01F 15/083* (2013.01); *E01F 15/088* (2013.01); *E04H 17/16* (2013.01); *E04H 17/22* (2013.01); *E04H 17/24* (2013.01); *Y10T 29/49947* (2015.01)

(58) Field of Classification Search
CPC ..... E01F 15/088; E04H 17/16; E04H 17/22; E04H 17/24; Y10T 29/49826
USPC ..... 256/13.1, 24, 65.14; 404/6, 9, 10
See application file for complete search history.

(56) References Cited

U.S. PATENT DOCUMENTS 5,015,119 A * 5/1991 Schmanski ..... E01F 7/06 256/13.1
5,152,507 A * 10/1992 Lee ..... E01F 13/026 256/13.1
5,186,438 A * 2/1993 Cross ..... E01F 7/04 256/12.5
7,104,720 B2 * 9/2006 Humphries ..... E01F 8/0017 256/13.1
7,445,403 B2 * 11/2008 Williams ..... E02B 3/16 404/6
7,562,453 B1 * 7/2009 Benner ..... A01G 13/10 256/1
8,001,880 B2 * 8/2011 White ..... E01F 13/12 404/6
8,303,209 B2 * 11/2012 Lewis ..... E01F 9/642 248/219.1
8,636,266 B2 * 1/2014 Gill ..... E04F 11/1855 256/24
2007/0252125 A1 * 11/2007 Thompson ..... E04H 17/003 256/24
2010/0257805 A1 * 10/2010 Di Lorenzo ..... E04B 1/043 52/477
2010/0295007 A1 * 11/2010 Preston ..... E01F 13/022 256/31
2011/0179727 A1 * 7/2011 Liu ..... F24J 2/5203 52/173.3
2012/0003039 A1 * 1/2012 Wallace ..... E01F 15/0423 404/6

* cited by examiner

MODULAR DEMOUNTABLE SAFETY PANELS, COMPATIBLE WITH APPLICATION ON CONCRETE BASES OR METAL BARRIERS AT MOTOR RACING CIRCUITS AND THEIR RESPECTIVE ASSEMBLY PROCESS

CROSS-REFERENCE TO RELATED APPLICATION

This application is a national application and claims the benefit of the priority filing date in Portuguese invention patent no. 108018 filed on Feb. 11, 2014 with the National Institute for Industrial Property of Portugal. The earliest priority date claimed is Feb. 11, 2014.

FEDERALLY SPONSORED RESEARCH

Not Applicable

SEQUENCE LISTING OR PROGRAM

Not Applicable

BACKGROUND

This is an invention related to motor racing circuit safety (for sports involving car and motorcycle competitions on racing circuits), resulting in a device and a process for assembling and disassembling safety fencing for motor sports circuits, suitable for installation on concrete bases or metal barriers.

This invention is considered particularly suited for urban circuits where the entire infrastructure of a motor racing circuit must be regularly installed, and then removed, in particular the safety structures, and specifically, the fencing that demarcates the racetrack area.

The invention can be installed on concrete bases or metal barriers, the two ways typically used to demarcate the track area for the purpose of separating the race area and the spectators' zone.

Being modular, they can be quickly assembled and disassembled, with an absolutely innovative advantage: any segment of fencing can be removed from anywhere in the structure protecting and delineating the circuit, affording enormous advantages for access and assistance.

Moreover, their robustness is ensured by means of fastening and structural interconnection between segments.

The IAF (International Automobile Federation) produced a set of internal guidelines intended to ensure the installation of safety systems around motor racing circuits to guarantee both the safety of the spectators, and the drivers themselves.

The product and process indicated here are mainly aimed at ensuring that this objective is met at motor racing events in urban areas, for both the existing IAF guidelines, and for the proper execution, and easy assembly and disassembly of the work.

Although the invention has been conceived primarily to be used in temporary motor circuits held in city centers, it is also suitable for use in facilities built for permanent use—racetracks.

The invention presented here, aims, in particular, to serve the concept, inherent in a city circuit, of a temporary installation, and provide:

Optimized and modular production of all constructional components;

Ease of transport;

Ease and speed of assembly;

Ease of access for assistance during the races;

Ease and speed of replacement;

Ease of reconfiguration; and

Ease and speed of disassembly.

Compatibility. This is a fully compatible set of modular elements, whether using concrete bases or protective metal barriers together with the demountable fencing panels.

Simplicity. The assembly and disassembly of the invention are very easy, inasmuch as they do not require skilled labor. It also has the advantage that any segment of protection can be replaced, in the event of damage to any part.

Accessibility. The invention makes it extremely easy to remove part of previously assembled sections, in order to create access points, or change any part of a previously assembled group of modules or previously erected segments of protection zones.

Safety. Every set of protection panels is formed by the repetition of modules of concrete bases or metal barriers and demountable fencing panels, and is fully structurally connected, which enhances the overall strength of the protection and prevents the projection of loose parts in the event of accidents.

Moreover, the overall safety of the event is also enhanced to the extent that the invention allows, for example, the creation, at the very moment when it is needed, of ambulance access to a part of the circuit where this type of access had previously not been possible.

State of the Art. Most protection systems, which use containment panels at existing motor racing circuits, do not allow the disassembly of any module independently and at any point.

In fact, such safety systems are conceived without considering their fundamental need to be as movable as possible, whether for performing repairs during races, or for opening or closing access points (openings in the system of bases or barriers).

Furthermore, their structural resistance is usually much lower than that required by the IAF's internal standards.

In addition, they do not allow the installation of steel cables for reinforcing and structurally connecting the system of fencing panels.

The structural interconnection of the panels is also very poor, as they depend on transitional pieces and are not directly connected to the uprights embedded in the concrete.

Finally, existing demountable panel systems cannot be installed on either cement bases or on metal protection barriers.

SUMMARY

This invention is concerned with a new type of demountable modular panel and its respective assembly process. Intended for use on motor sports circuits—particularly on urban circuits—it has the advantage of being easily assembled and disassembled, allowing easy access to any point on the circuit. It can be used on metal barriers or on concrete bases (13) fitted with "U" section metal guides (14) at their ends, into which a metal support profile (15) is inserted. Above the base, a fencing panel (3) is placed, with a top section (3-*a*) inclined at 45°. A tubular metal shaft (11) is introduced vertically through metal connectors (12) and tightly clamped in rectangular retention brackets (9). The attachment of the panel is reinforced by "L" section metal brackets (17) and respective bolts with washers (16).

DRAWINGS

Figure 5:
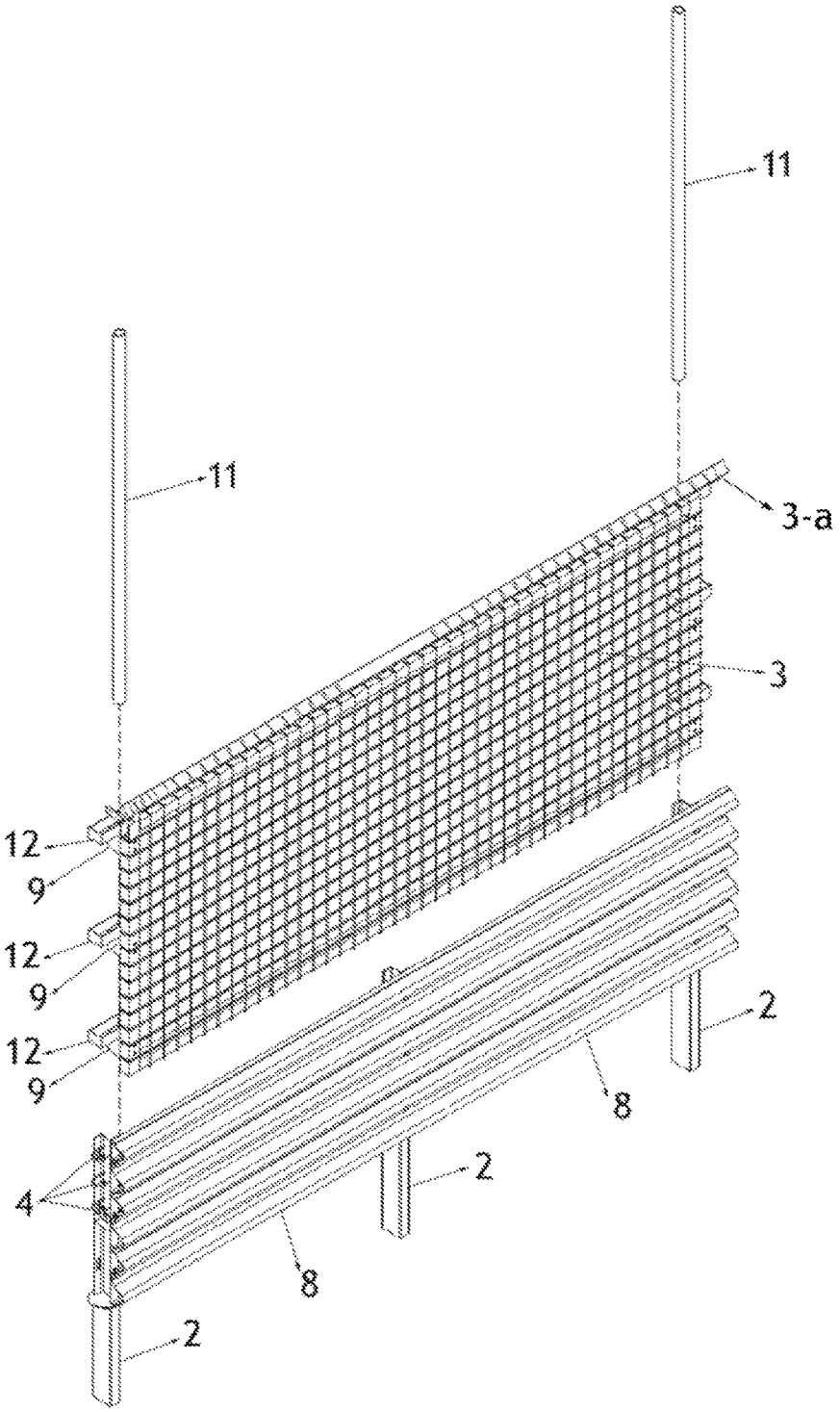
FIG. 5 represents the fencing panel (3) and respective top section (3-*a*) in vertical alignment above the metal barrier (8), revealing the tubular metal shaft (11) aligned with the rectangular retaining brackets (9), with the metal connectors (12) and with the top of the vertical post (2) and respective threaded rods (4)
Figure 6:
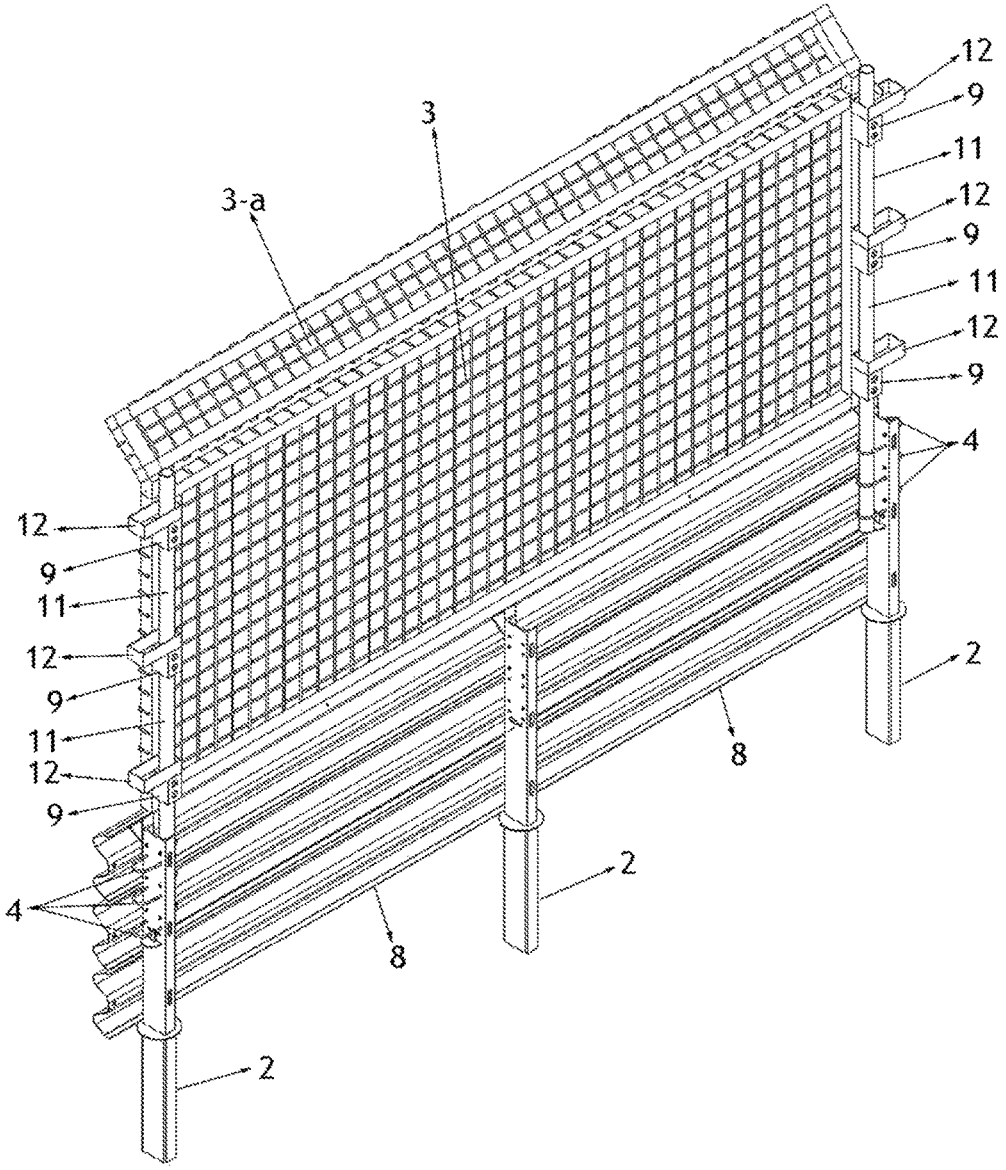
Figure 7:
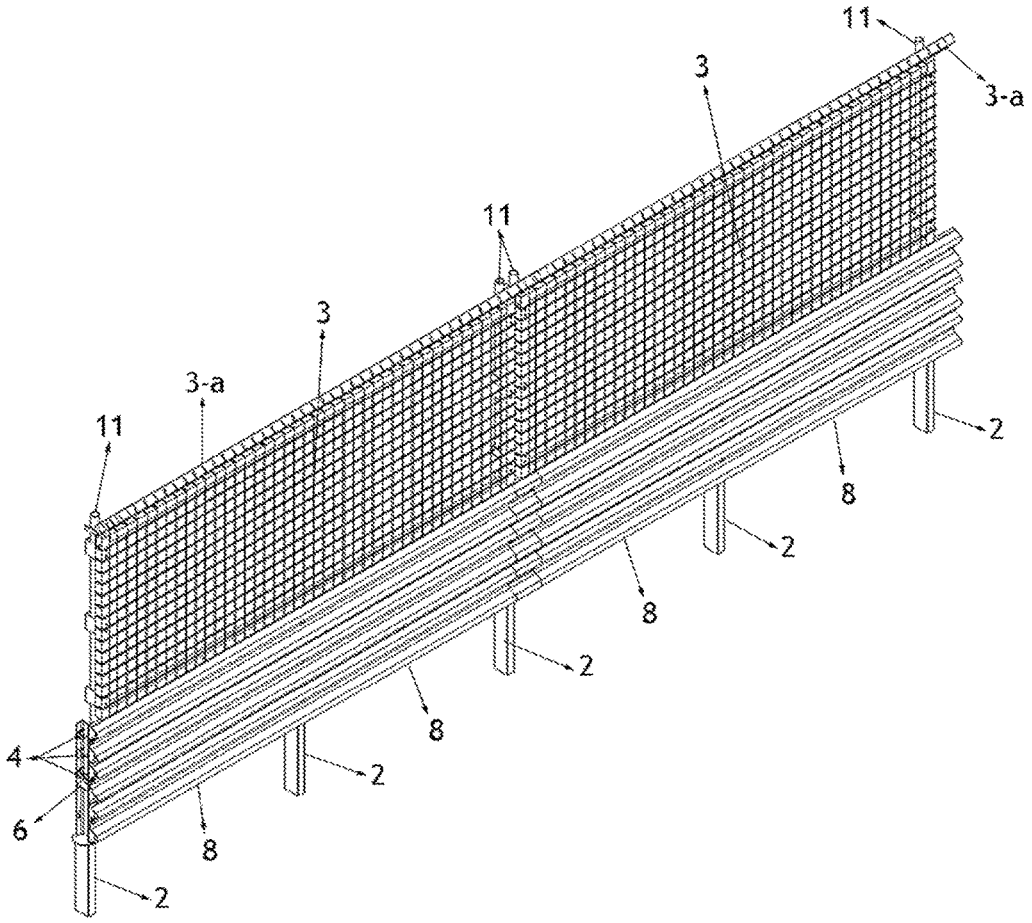
Figure 8:
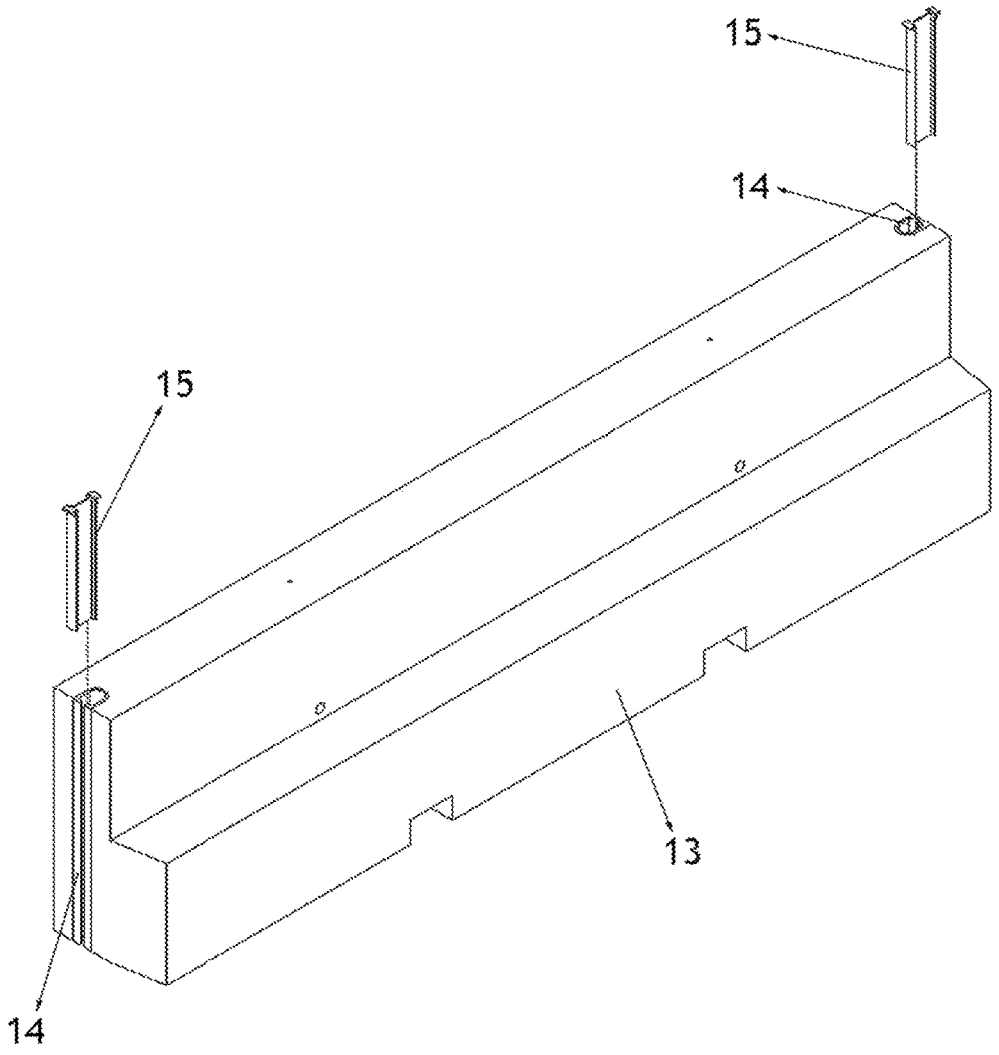
Figure 9:
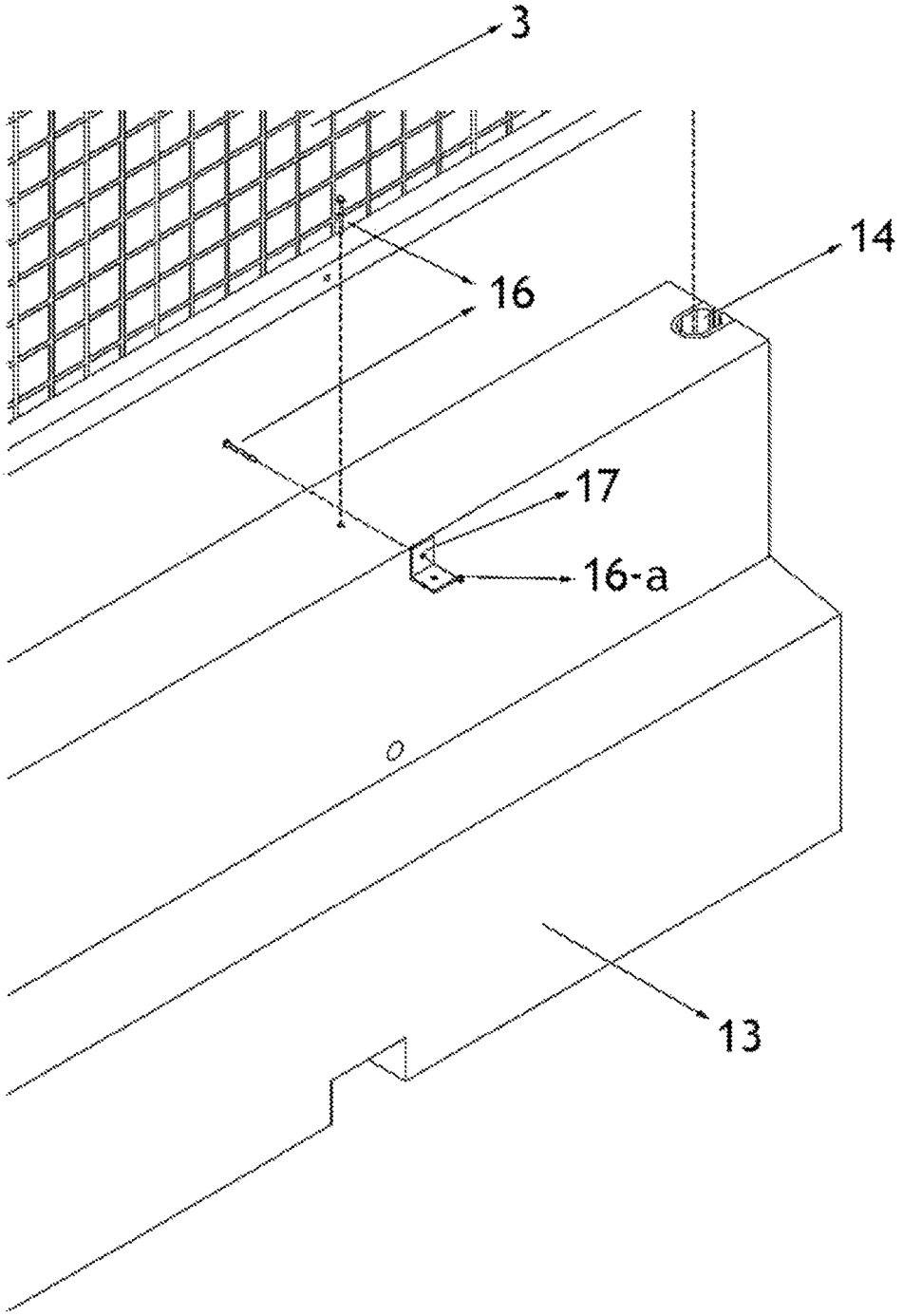
Figure 10:
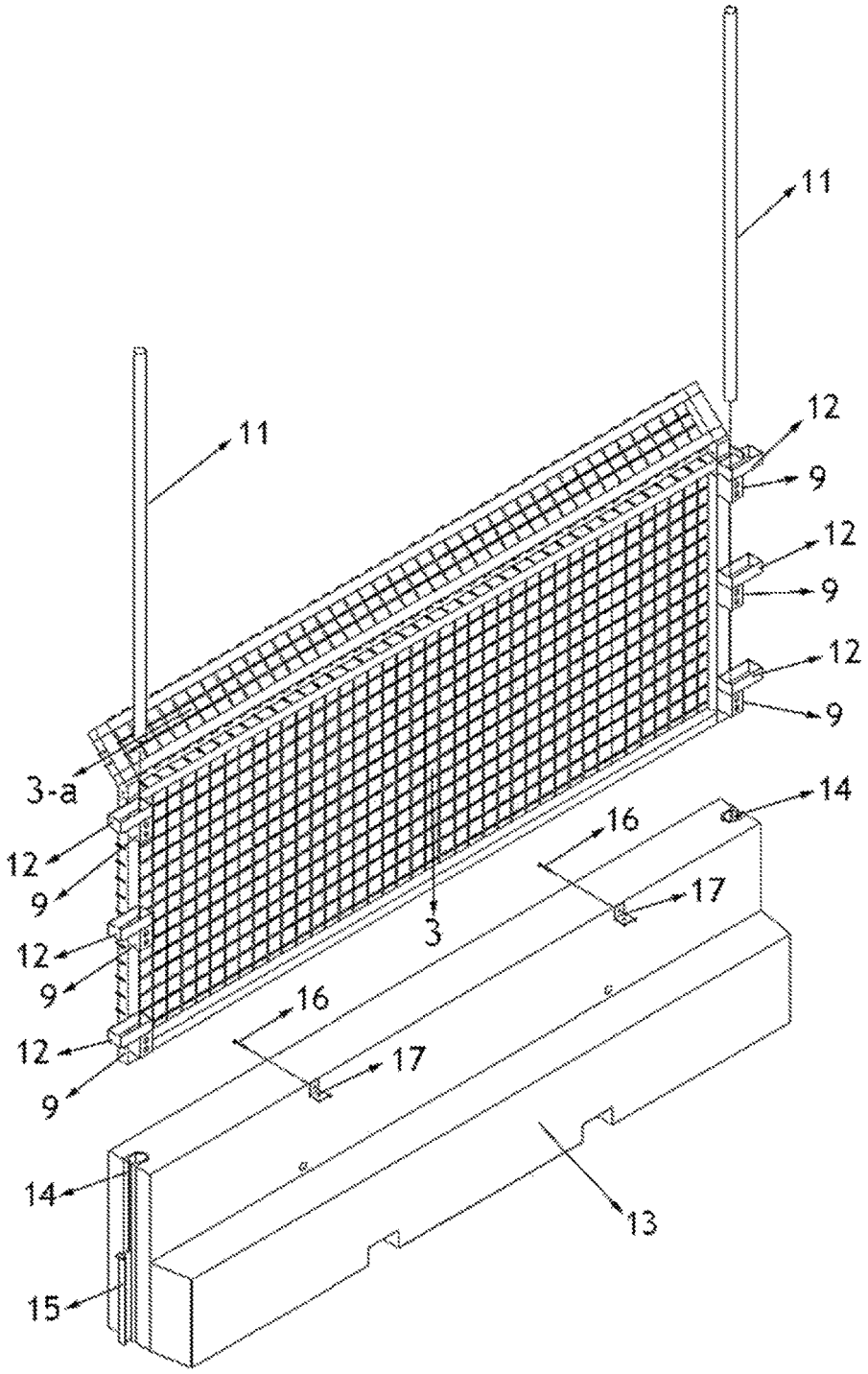
Figure 11:
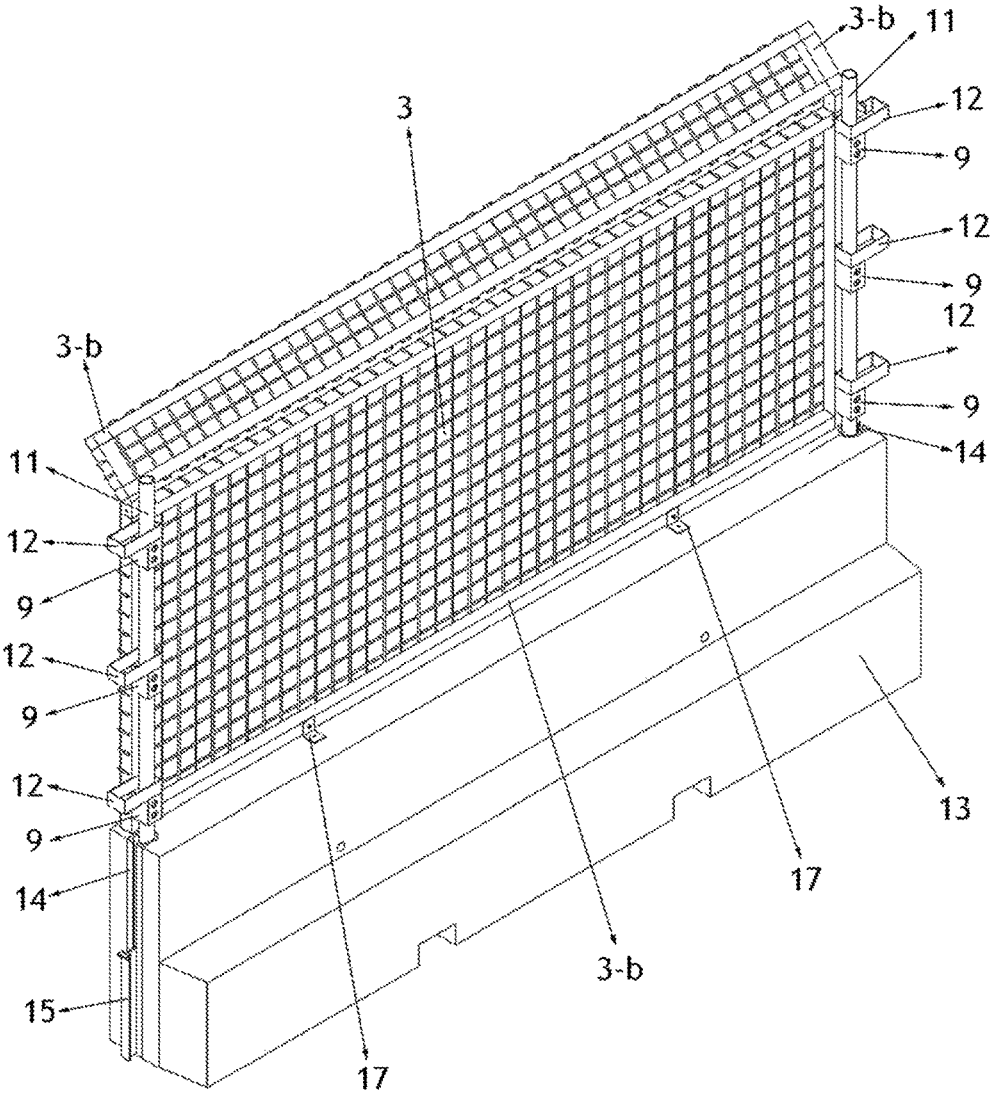
Figure 12:
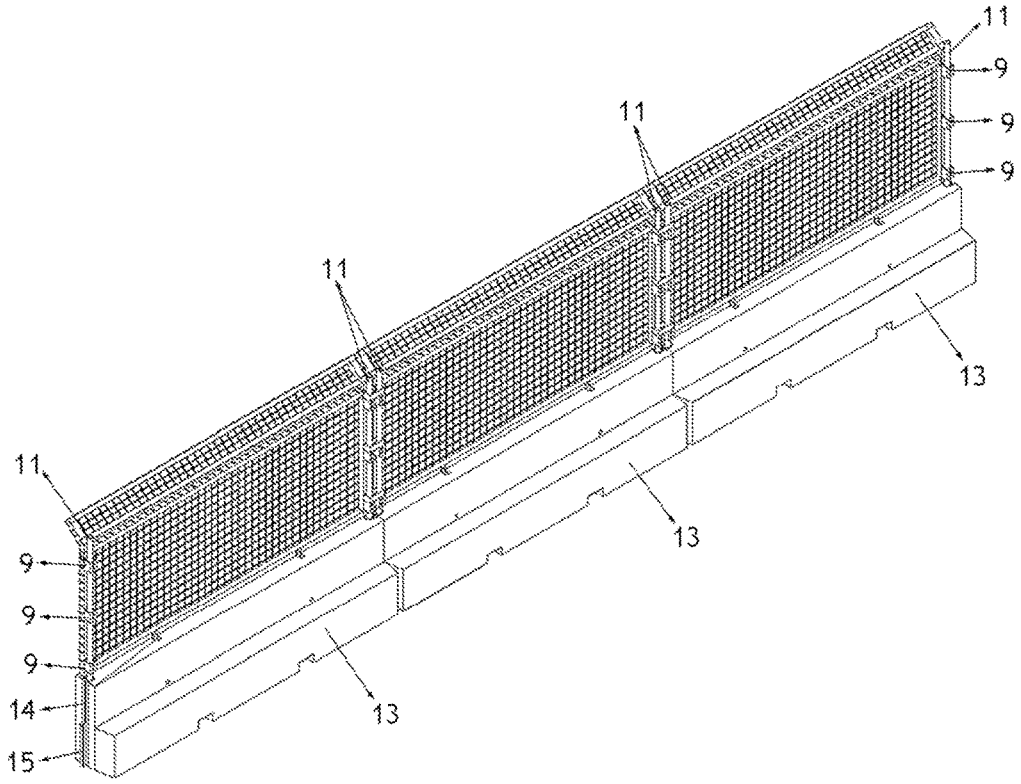

FIG. 6 shows, in a rear view of the fencing panel (3), its top section (3-*a*), with this already mounted on the metal barriers (8), the tubular metal shaft (11) already inserted, secured by the threaded rods (4) and by the rectangular retaining brackets (9), and effectively occupying half of the interior area of the metal connectors (12), with the tubular metal shaft (11) also visible mounted on the vertical post (2);

FIG. 7 shows a front view of the fencing panel (3) and its respective top section (3-*a*) mounted in series over metal barriers (8), with the tubular metal shaft (11) secured by the rectangular retaining brackets (9) being visible, as are the threaded rods (4) that help to secure this tubular metal shaft (11) and the fixed stop (6) of the vertical post (2);

FIG. 8 represents a concrete base (13) with a metal guide (14) in the form of a "U" channel at each end, into which the metal support profile (15) is inserted;

FIG. 9 shows a detail of the reinforcement of the attachment of the fencing panel (3) to the concrete base (13), using an "L" section steel bracket (17), showing the bolts with washers (16) and nuts (16-*a*) for its respective attachment to the metal guide (14);

FIG. 10 shows, similarly to FIG. 5, the fencing panel (3) in vertical alignment above the concrete base (13), respective metal guide (14) and metal support profile (15), showing the tubular metal shaft (11), at each end of the fencing panel (3), its top section (3-*a*) at a 45° angle, with this tubular metal shaft (11) aligned with the rectangular retaining brackets (9), the metal connectors (12) and also showing, the "L" section mounting bracket (17) and respective bolts with washers (16);

FIG. 11 represents, similarly to FIG. 6, a front view of the fencing panel (3) mounted on a concrete base (13), with the tubular metal shaft (11) already fitted, and secured by rectangular retaining brackets (9) and metal connectors (12) and inserted into the metal guide (14) at the ends of this concrete block (13) and supported by the metal support profile (15), and showing the "L" section mounting brackets (17) that reinforce the attachment of the fencing panel (3) through its square section tubing (3-*b*);

FIG. 12 shows a front view of three panels mounted on concrete blocks (13), with the tubular metal shaft (11) visible and secured by rectangular retaining brackets (9) and by the metal guide (14) and supported by the metal support profile (15).

DESCRIPTION

The invention permits flexibility in the use of fencing panels given that they can be mounted on both concrete blocks and on metal barriers. Any fencing panel can be disassembled independently, without needing to move adjacent panels.

There are also advantages in transporting the system because the panels have no projecting elements, being solely composed of the main frame from which all the accessories can be detached and transported separately.

The invention incorporates the interlocking of adjacent panels, enabling their complete linear structural interconnection using very few pieces. The panel is secured to the concrete block or metal barrier to prevent it from being projected in the event of an impact.

The top section of the fencing panel that prevents debris from being projected outside of the circuit is transported separately from the main fencing frame, which optimizes the transport process.

Indicatively, there are three points structurally connecting the fencing panels to the vertical posts that confer additional strength in the event of impact.

An uninterrupted opening is ensured between these three connection points and the fencing frame in order to permit the subsequent installation of steel cable, if it proves necessary, to guarantee additional strength for the whole system.

The pieces that guarantee structural continuity between the different panels are installed with stops that prevent their projection in the event of an impact.

The posts that are embedded in the concrete bases or the metal barriers, sit immediately behind the posts of the demountable fencing frames, which ensures greater strength for the whole assembly.

The mesh of the fencing contained in the demountable panels, made by electro-welding, has its horizontal rows facing the track, thus reducing damage in the event of being struck by debris detached from a colliding car, which will reduce the risk of damaging the system, reduce the projection of pieces outside of the track and also the physical damage to a driver or rider thrown against the mesh fencing.

The mesh fencing is wrapped around the panel frame and is welded along the entire surface of contact.

The panel allows for openings to be created for marshals and photographers at any point in the circuit, even after it has been assembled at that point, through the simple substitution of a standard fencing panel by a fencing panel incorporating one of these openings (for marshals or photographers).

The demountable panel is sized and developed so as to allow different heights of panel.

Use on Metal Barriers. The invention allows a single module or panel to be removed at any moment, without having to disassemble one of the adjoining panels.

The posts that support the metal barriers are fitted with boltholes and stops in order to allow the installation of the demountable fencing.

Use on Concrete Bases. With the invention presented here, any base can be assembled and disassembled independently, without the need to move adjacent bases.

The invention features a slot-in system to interconnect bases that allows different sizes and configurations of bases to be joined without any difficulty.

The concrete bases also have a stepped configuration in order to guarantee the weight per linear meter required in the IFA rules and, at the same time, to enable track marshals to cross them more easily during races.

DESCRIPTION OF BEST MODE TO IMPLEMENT INVENTION

Assembly of demountable panels on metal barriers. This mounting option for the invention can be seen in FIGS. 1 to 7.

Firstly, a hole is opened in the existing paving, whether in a pavement, road or planted area, that enables a metal sleeve (1) to be embedded that will receive the vertical post (2) to support the metal barriers (8).

After the hole has been made, it will be filled with concrete in sufficient quantity to ensure perfect coverage, structural solidity and leveling of the metal sleeve (1). This sleeve may be fitted with a metal cap that allows it to be covered whenever the invention is not installed.

This is followed by the placement of the vertical post (2) for the metal barriers (8) in the opening at the top of the metal sleeve (1).

The vertical post (2) is configured to ensure that it is always inserted to the same depth.

Next, the threaded rods (4) are fitted for the subsequent securing of the tubular metal shaft (11) to connect the demountable fencing panel (3).

Following this, the movable stop is placed (6-*a*) that determines the extension of the tubular metal shaft (11) that becomes structurally connected to the vertical post (2) of the metal barriers (8).

This tubular metal shaft (11) and its respective securing and connecting pieces are the critical elements for both the structural continuity of the various panels, and for their rapid assembly and disassembly when necessary.

Next, the metal barriers (8) are installed, and are attached to all the previously installed vertical posts.

Between the upper metal barrier and the vertical post (2) a bracket (5) should be placed to guarantee added protection to the top of the vertical post (2).

The fencing panel (3) is demountable and is composed of electro-welded mesh fencing and framed by square tubular profile (3-*b*).

Figure 1:
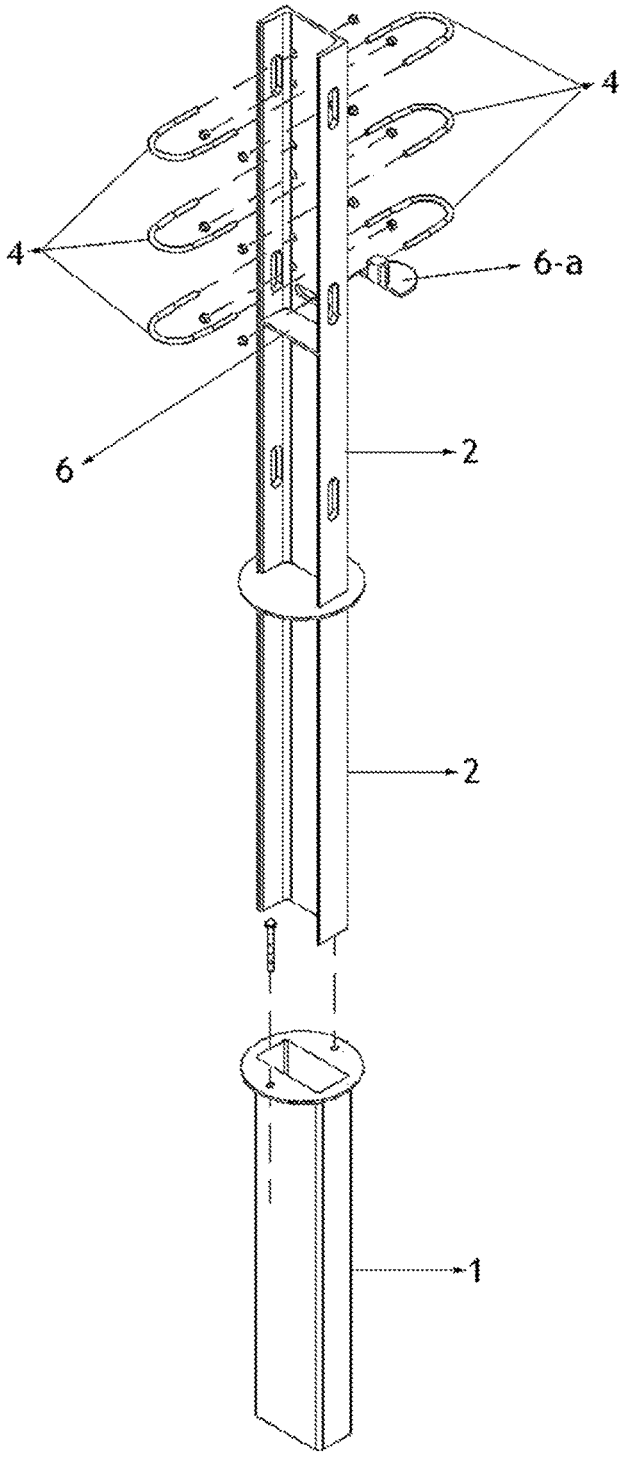
FIG. 1 represents the vertical alignment of the supports to be mounted on metal barriers, revealing the metal sleeve (1), the vertical post (2) with the fixed stop (6), the movable stop (6-*a*) and the threaded rods (4) on the upper section of this vertical post (2)
Figure 2:
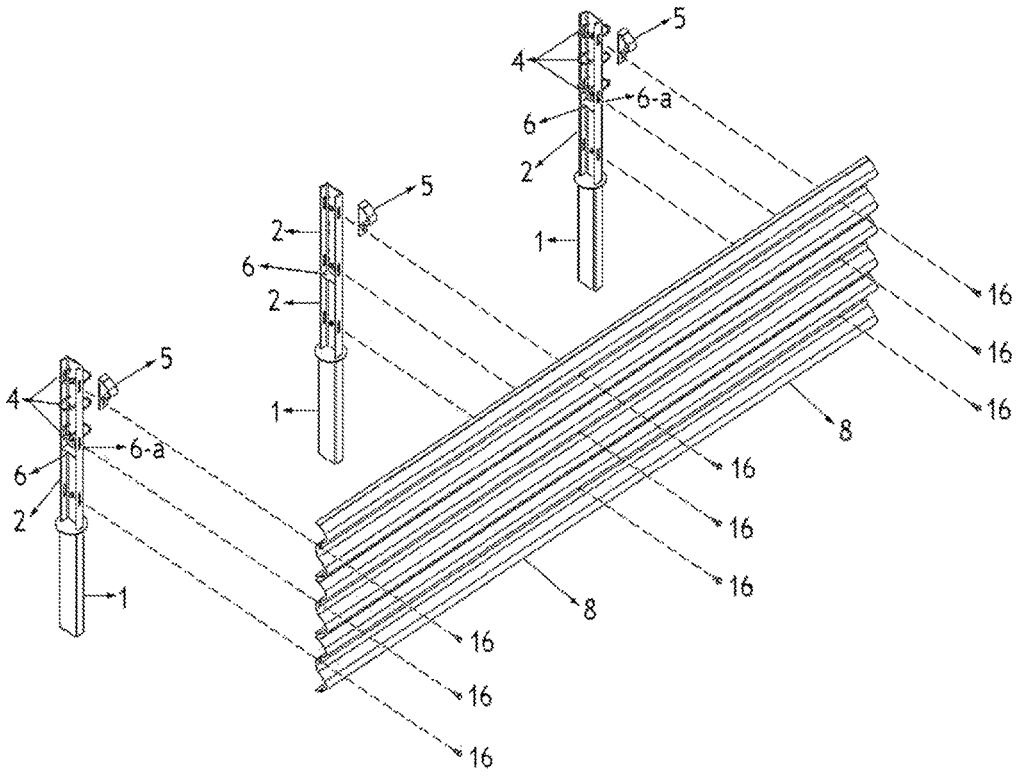
FIG. 2 shows the vertical posts (2) in alignment, mounted in metal sleeves (1), the threaded rods (4), the bracket (5), the fixed stop (6) and the moveable stop (6-*a*), as well as the metal barrier (8) and bolts with washers (16)
Figure 3:
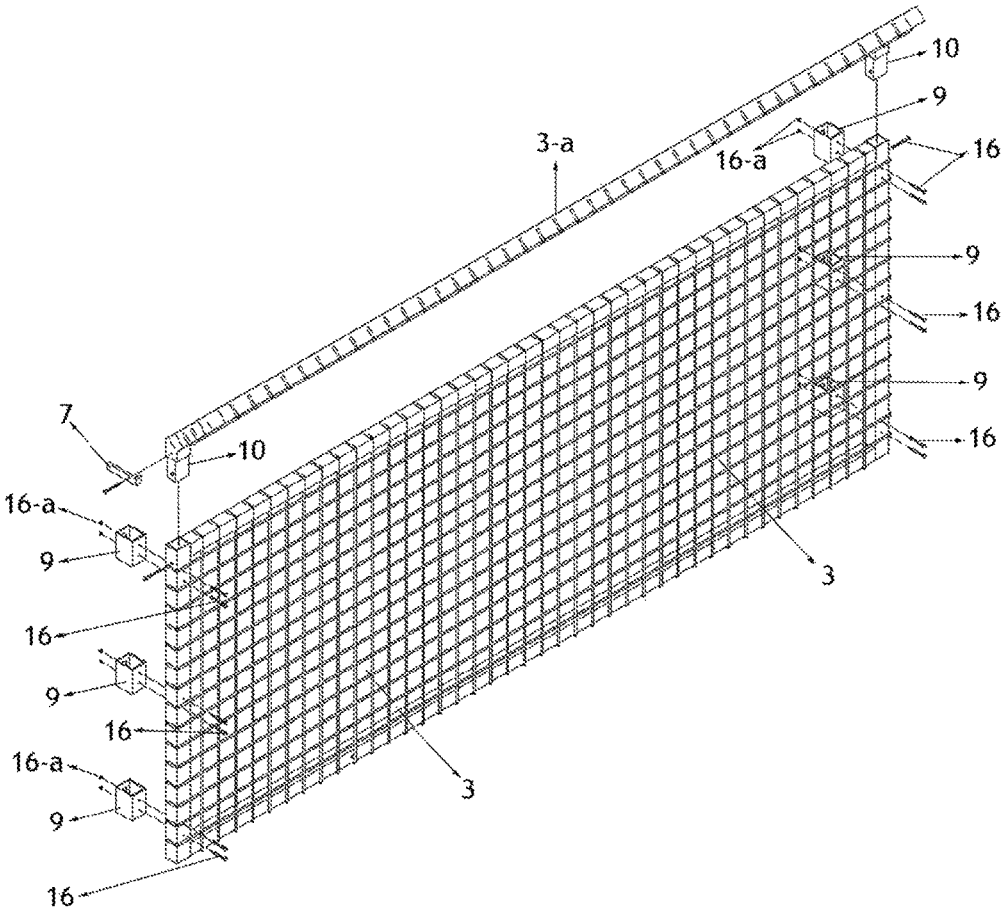
FIG. 3 shows the fencing panel (3) and its top section (3-*a*), revealing the connection area (10) where these two parts are fitted together, the fastening piece (7) for this top section (3-*a*), the rectangular retaining brackets (9), as well as bolts with washers (16) and nuts (16-*a*) for their respective attachment.
Figure 4:
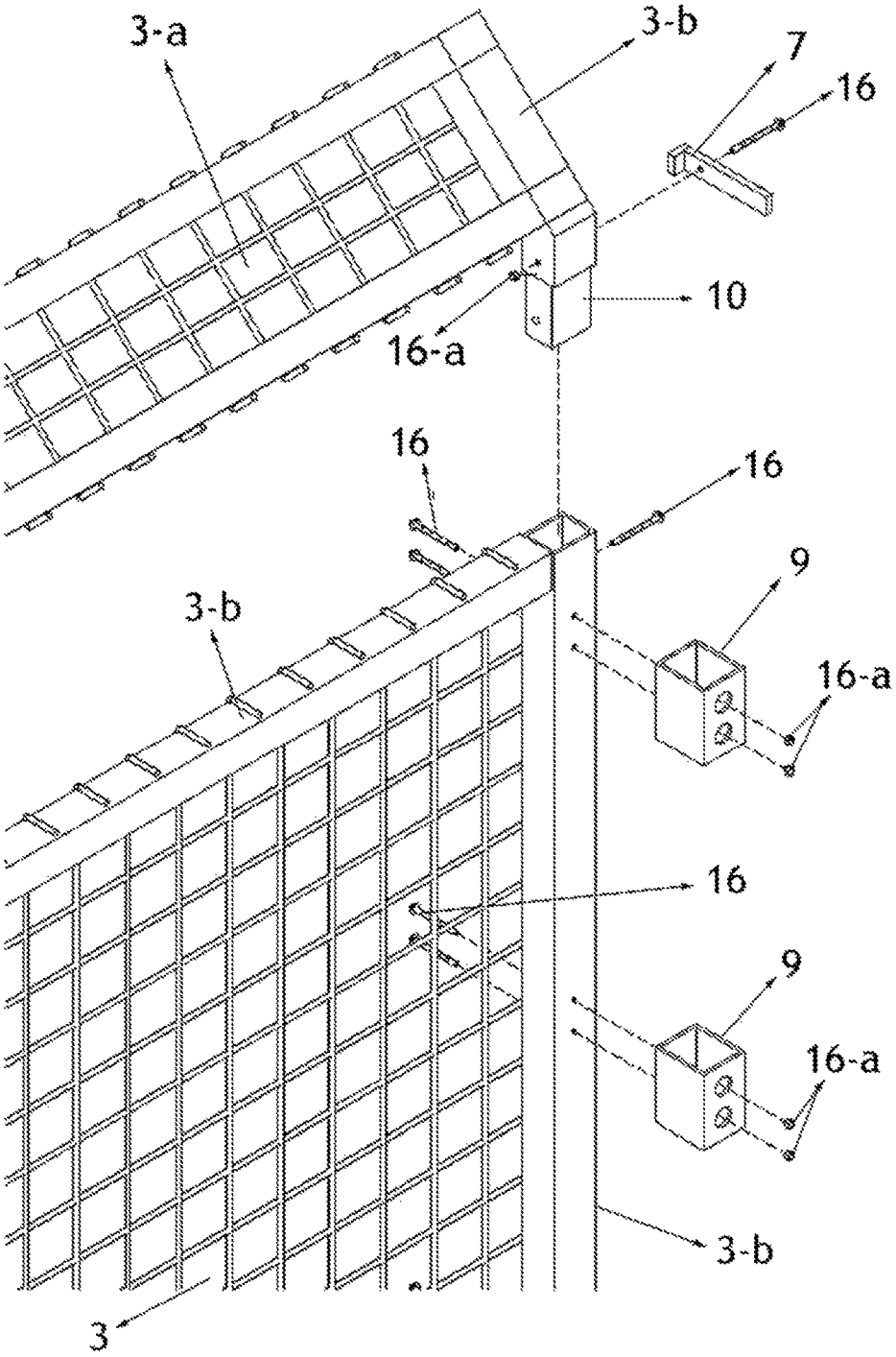
FIG. 4 represents, the two parts of the fencing panel (3) in more detail, showing the connection area (10) and respective fixing piece (7), the rectangular retaining brackets (9), the bolts with washers (16) and the nuts (16-*a*) for securing them, and also shows that the fencing panel (3) and its top section (3-*a*) are framed by square tubular profile (3-*b*)

Following this, the insert (10) of the top section (3-*a*) is fitted into the fencing panel (3) in order to guarantee that it sits at an angle of 45° to this panel (FIGS. 3, 4 and 6).

Afterwards, this is secured to ensure the bracing of the square tubular profile (3-*b*) to the upper end of the sides of the fencing panels (3).

After the preparation of the demountable fencing panel (3) described earlier, this panel is transported and raised in a vertical position over the metal barriers (FIG. 5).

Finally, the tubular metal shaft (11) is installed vertically. This tubular metal shaft (11) will pass simultaneously through the interior of the metal connectors (12), fixed to the sides of the fencing panels (3), and through the rectangular retaining brackets (9).

These rectangular retaining brackets (9), enclosing and gripping the tubular metal shaft (11), guarantee a robust connection between adjacent panels. However, a quick loosening of the retaining and clamping elements—the threaded rods (4), the rectangular retaining brackets (9) and the metal connectors (12)—is sufficient for the tubular metal shaft (11) to be removed and the entire assembly to be dismantled and removed from its position, allowing immediate access if necessary.

The tubular metal shaft (11) will be guided by three threaded rods (4) so that its base is supported on the vertical post (2) of the metal barriers (8).

In the event that reinforcement of the proposed safety mechanism is desired, optional steel cables can be installed in the space between the tubular metal shaft (11) and the demountable fencing panel (3), between the three points defined by the metal connectors (12).

Assembly of the invention when using concrete bases. This mounting option for the invention can be seen in FIGS. 8 to 12.

The concrete bases (13) are placed in the desired locations and alignments. They must be properly aligned to permit the perfect structural connection with these concrete bases (13) in the subsequent installation of the invention.

The concrete bases (13) have a metal guide at each end (14). This guide is configured in a "U" shaped channel (FIG. 8)

An "I" section metal support profile (15) is inserted in this metal guide (14).

The double flange configuration of this metal support profile (15) ensures structural union with adjacent bases.

As in the previous mounting option, the demountable fencing panel (3) is prepared.

The metal connectors (12) are attached on the side of the square tubular profile (3-*b*) of the fencing panel (3) using bolts with washers (16) and nuts (16-*a*).

The top section of the fencing panel (3) is attached to this by insertion (10), guaranteeing an angle of 45° to the vertical plane. The attachment is reinforced by bolts with washers (16) and nuts (16-*a*).

A fastening piece (7) is attached to the top end of the fencing panel sides (3). This fastening is reinforced by bolts with washers (16) and nuts (16-*a*).

After the preparation of the demountable fencing panel (3) described earlier, it is transported and raised in a vertical position over the concrete base (FIG. 10).

A tubular metal shaft (11) is installed vertically and will pass simultaneously through the interior of the metal connectors (12), fixed to the sides of the fencing panels (3) and through the rectangular retaining brackets (9).

These rectangular retaining brackets (9), enclosing and gripping the tubular metal shaft (11), guarantee a robust connection between adjacent panels.

The tubular metal shaft (11) will be guided so that it is inserted into one of the metal guides (14) at each end of the concrete base (13), and sit on the "I" section metal supporting profile (15) which by its insertion, structurally unites and braces the various bases and the panels placed over them.

The fencing panel (3) is more securely fastened to the concrete base (13) by "L" section metal brackets (17) in order to prevent them being projected in the event of an impact.

Here too, in the event that reinforcement of the proposed safety mechanism is desired, optional steel cables can be installed in the space between the tubular metal shaft (11) and the demountable fencing panel (3), between the three points defined by the metal connectors (12).

All the parts were developed in order to guarantee the tolerances necessary to permit assembly along a curve and on surfaces with differing elevations, thus ensuring that there will always be a solution for the transitional conditions that usually occur in a temporary racing circuit installed in an urban center.

In the event that taller panels are necessary, extensions should be installed on the upper edge of the panels described in this invention and subsequently, their 45° angled top sections.

What is claimed:

1. A demountable modular safety panel for installation on concrete bases at motor racing circuits, the demountable modular safety panel comprising:

a tubular metal shaft (11), vertically aligned with ends of a fencing panel (3), the fencing panel (3) fastened to the tubular metal shaft (11) by a plurality of rectangular retaining brackets (9) and a plurality of metal connectors (12);

a top section (3-*a*) framed by a square tubular profile (3-*b*), the top section (3-*a*) having an insertion portion (10) configured to mount the top section (3-*a*) to the fencing panel (3) at a 45° angle relative to the fencing panel (3); and wherein the demountable modular safety panel comprises two "I" section metal supports (15) configured to engage two "U" section channel guides (14) at either end of each concrete base (13) such that each "I" section metal support does not protrude from either end of the concrete base the tubular metal shaft is also received inside the "U" section channel guides along with the "I" shaped section, and an "L" section metal bracket (17) configured to affix the fencing panel (3) of the top section (3-*a*) to the concrete base (13).

* * * * *